United States Patent [19]

LiCausi

[11] 4,397,165

[45] Aug. 9, 1983

[54] LOCKING MECHANISM FOR A MONEY BOX ASSEMBLY HAVING A FUSIBLE CAM

[75] Inventor: Anthony LiCausi, Maspeth, N.Y.

[73] Assignee: Kidde, Inc., Clifton, N.J.

[21] Appl. No.: 223,897

[22] Filed: Jan. 9, 1981

[51] Int. Cl.[3] ..... E05B 63/00

[52] U.S. Cl. ..... 70/1.5; 70/422

[58] Field of Search ..... 70/1.5, 1.7, 422; 109/59; 49/7, 8; 169/42

[56] References Cited

U.S. PATENT DOCUMENTS 3,897,828 8/1975 Glover ..... 169/42

FOREIGN PATENT DOCUMENTS 20877 of 1912 United Kingdom ..... 70/1.5

*Primary Examiner*—Robert L. Wolfe

*Attorney, Agent, or Firm*—McAuley, Fields, Fisher, Goldstein and Nissen

[57] ABSTRACT

The present invention is directed to an improved locking mechanism for a money box assembly. The mechanism includes a fusible plastic cam which acts as a transmission member operatively connecting the lock to locking bolts. The bolts engage with the wall of a housing to which the money box assembly is mounted. The cam is formed of a material having a melting temperature substantially lower than the melting temperature of the material forming the lock. Any attempt to gain access to the money box by melting the lock and then operating the cam by a screwdriver or other tool will be frustrated since the drive cam linkage will have been destroyed or rendered inoperative by the heat thereby breaking the link between the lock and the locking bolts so that the money box assembly remains locked in place.

4 Claims, 7 Drawing Figures

LOCKING MECHANISM FOR A MONEY BOX ASSEMBLY HAVING A FUSIBLE CAM

BACKGROUND OF THE INVENTION

1. Field of the Invention

This invention relates, generally, to an improved locking mechanism for a money box assembly. More specifically, the invention is directed to a fusible cam rotatably driven by operation of the lock to operate locking bolts by which the money box is locked to the housing of a coin-operated mechanism. Attempts to gain entry to the money box by utilizing a torch to melt the lock mechanism will melt or destroy the cam thereby preventing operation of the locking bolts so that the money box remains locked in place.

2. Description of the Prior Art

Money boxes with integral lock mechanisms have been in use for some time to catch and collect coins dropping from the coin operated mechanisms used to operate various coin operated appliances, vending machines or the like. The money box assembly is generally secured to a front wall of a housing which is mounted on the applicance or vending machine. The wall of the housing has a fitted opening through which the money box is received. The assembly includes a face plate connected to the money box on which there is mounted a tumbler-type key operated lock that operates transversely extendable locking bolts by which the money box assembly is locked to the front wall of the housing. The arrangement serves to locate the money box within the housing to prevent unauthorized access thereto.

One of the problems associated with such money box assemblies is that of security. For example, operation of the tumbler-type lock is by means of a key which rotates a shaft dirvingly connected to a metallic cam which causes the cam to rotate conjointly therewith. The cam acts as a transmission member and serves to connect the lock to the locking bolts. In operation, rotation of the cam in one direction causes the locking bolts to extend outwardly and engage with the wall of the housing to lock the money box assembly in place. Rotation of the cam in the opposite direction causes the locking bolts to retract, thereby permitting the money box assembly to be removed from the housing to gain access to the contents of the box.

The lock mechanism is usually made of die cast metal which is relatively easily melted using a torch. Thus, unathorized persons wishing to gain access to the money box have been known to apply a torch to the lock mechanism to melt the lock while, at the same time, being carefull not to melt the metallic cam. This enables a screwdriver or other similar tool to be inserted into the mechanism to rotate the cam, even though the lock is destroyed, in a manner to disengage the locking bolts from the wall of the housing.

The present invention is directed toward rendering the cam transmission member inoperative if a torch is applied to destroy the lock. By rendering the cam inoperable, the locking bolts will remain in their extended position to prevent withdrawal of the money box assembly from the housing.

SUMMARY OF THE INVENTION

The present invention is directed toward replacing the metal cam with one made of plastic or fusible material so that when the heat is applied to the lock mechanism it also will melt the cam thereby destroying the transmission link between the lock and the locking bolts. Once the fusible cam is destroyed, the locking bolts will remain in their extended position irrespective of rotation of the tumbler lock mechanism thereby leaving the money box assembly locked in place. This reduces incidences of theft by thwarting unauthorized attempts to gain access to the money box assembly by applying a torch to the lock mechanism.

Accordingly, an object of the present invention is to defeat unauthorized entry into money boxes by persons utilizing a torch to melt the lock mechanism.

A further object and feature of the invention is to provide a simple and inexpensive means to present easy entry into money boxes, which can be accomplished with a minimum of change to existing locks or lock structures.

The above and other objects, features and advantages of the present invention will become more apparent from a consideration of the following detailed description when taken in conjunction with the accompanying drawings.

DESCRIPTION OF THE PREFERRED EMBODIMENT

Figure 1:
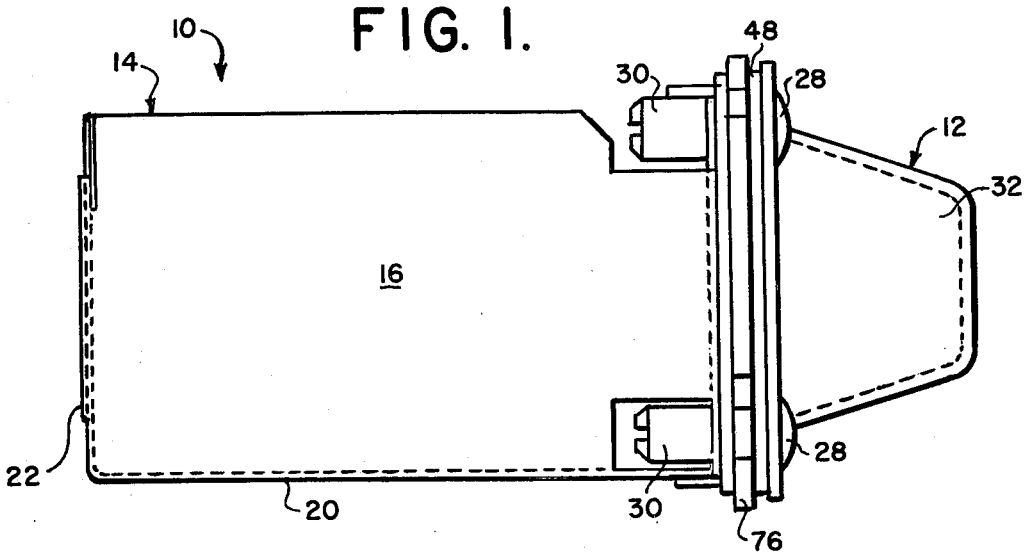
FIG. 1 is a side elevational view of a money box assembly constructed in accordance with the present invention.

Referring to the drawings, FIG. 1 illustrates a money box assembly 10 having a lock mechanism 12 constructed in accordance with the present invention. Assembly 10 includes a money box 14 having opposed side walls 16, 18, bottom wall 20, back wall 22 and front flanges 24. A pluraity of openings 26 are formed in flanges 24 through which pass the threaded portions of bolts 28 for engagement with slotted nuts 30. Bolts 28 and nuts 30 represent fastening means which serve to connect lock mechanism 12 to money box 14.

Since the front of lock mechanism 12 is normally exposed when money box assembly 10 is locked in place to the housing of a coin-operated mechanism, each of the bolts 28 has a smooth head to restrain attempts to disassemble the lock mechanism from money box 14 by means of a screwdriver or other similar tool. The nuts 30 are securely fastened to bolts 28 by means of a screwdriver passing through suitable cut-out openings in the back wall 20 of money box 14.

Figure 2:
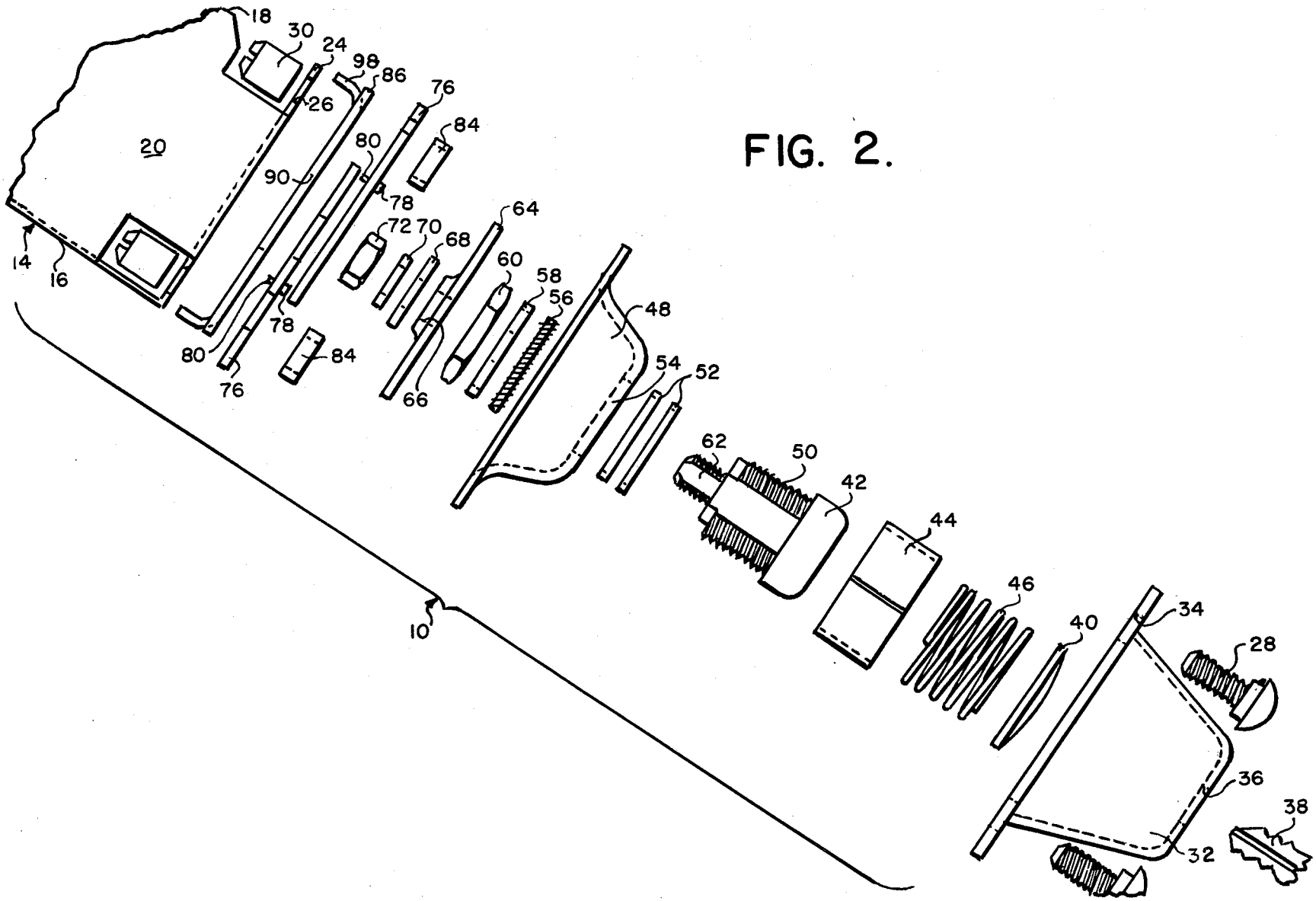
FIG. 2 is an exploded top plan view of the money box assembly of FIG. 1.

FIG. 2 is an exploded view of the money box assembly 10, particularly illustrating the various elements which constitute lock mechanism 12. The mechanism is provided with a cone shaped front plate shield 32 having openings 34 in the plate through which pass threaded portions of bolts 28. Another opening 36 is centrally provided in the raised front wall of shield 32 for receiving a coded key 38 to operate the lock mechanism. A slotted disc 40 is received within cone shaped shield 32 through its open back end and is positioned to freely rotate therein. Disc 40 serves as additional protection to the lock mechanism by restricting access to the tumbler lock 42 except by means of the key 38 passing through the slot therein. Disc 40 is spaced from tumbler lock 42 by means of cylindrical spacer 44. A spring 46 is fitted within spacer 44 having one end bearing against disc 40 and its opposite end bearing against the raised front wall of an intermediate cone shaped plate 48 to which lock 42 is fastened as hereinafter described. When the mechanism is assembled, spring 46 and spacer 44 hold disc 40 in abutment with the inner raised surface of shield 32 while still permitting the disc to rotate when key 38 is inserted therethrough to operate lock 42.

Lock 42 is of a conventional tumbler-type design and has an outer threaded surface 50 which passes through spacer 52 and through a central opening 54 in intermediate plate 48 whereupon the lock is secured to said plate by a fastening arrangement including lock washer 56, spacer 58 and nut 60. One or more spacers 52 may be used to support lock 42 in proper relation to plate shield 32 for operation of the mechanism by key 38.

Lock 42 also has a rearwardly extending threaded shaft 62 coupled to the inner workings of the lock so as to rotate by operation of key 38. When lock 42 is fastened to plate 48 by means of the threaded engagement of nut 60 on to threaded lock portion 50, the threaded shaft 62 is in position to engage with a cam transmission member 64 as hereinafter described.

Figure 3A:
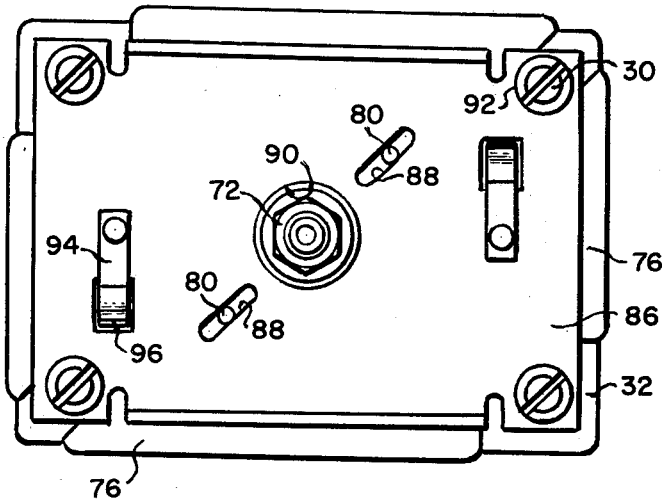
FIGS. 3A, 3B and 3C are rear elevational views of the cam/locking plate mechanism with successive portions removed from the mechanism to show the interrelationship between its constituents and the operation thereof.
Figure 3B:
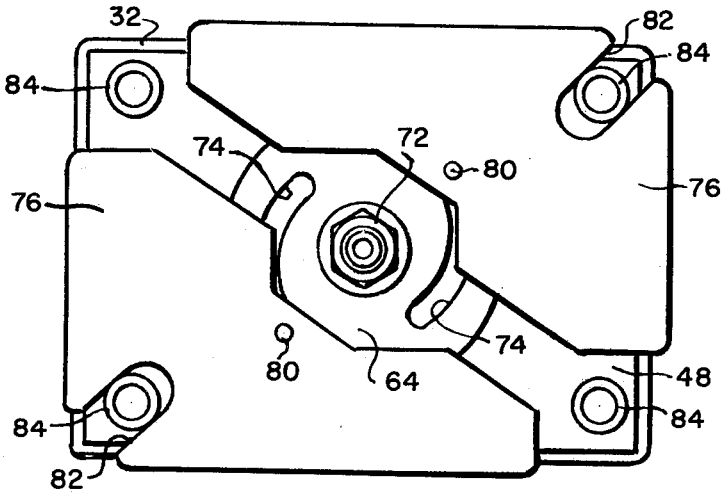
Figure 3C:
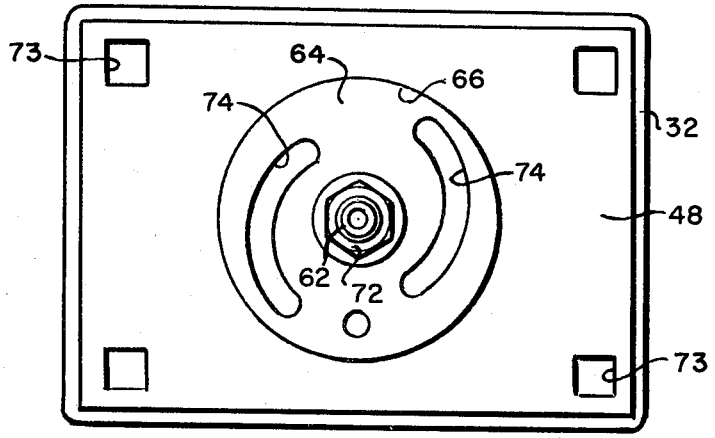

Cam 64 has a central opening 66 corresponding in shape to the outer configuration of shaft 62. The arrangement is such that cam 64 is keyed to shaft 62 for rotation conjointly therewith. Fastening members in the form of washer 68, lock washer 70 and nut 72 engage with threaded shaft 62 for securing cam 64 in place. In assembling the unit together, a subassembly is formed consisting of lock 42, intermediate plate 48 and cam 64. FIG. 3C illustrates cam 64 in its assembled position to intermediate plate 48. A plurality of openings 73 are formed in plate 48 through which passes the threaded portions of bolts 28.

Figure 4:
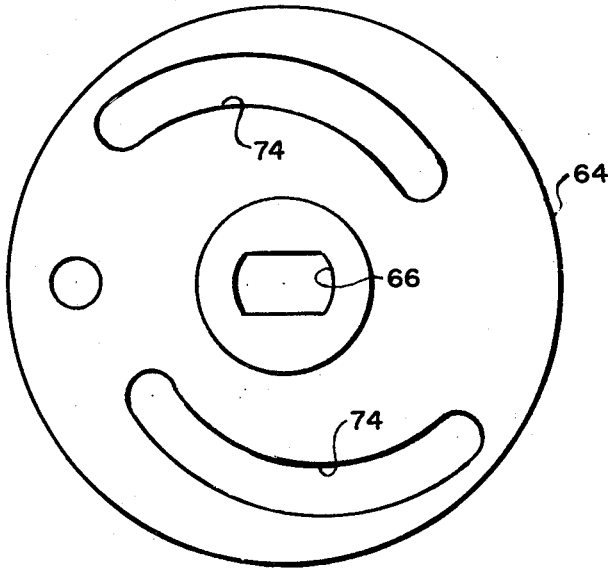
FIG. 4 is a plan view of a fusible cam according to the present invention.
Figure 5:
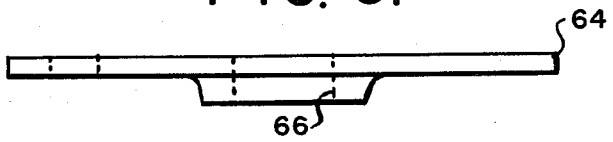
FIG. 5 is a side elevational view of the cam of FIG. 4.

Cam 64 is formed having a pair of curved camming slots 74, as shown in FIG. 4. The cam drivingly engages with a pair of locking bolts 76 by means of pins 78 which project outwardly of one side of bolts 76 and are received in the camming slots 74. FIG. 3B illustrates the engagement of cam 64 with locking bolts 76. Slots 74 are formed to spiral outwardly in a counterclockwise direction as shown in the drawings. As will now be apparent, when pins 78 are received in slots 74 and cam 64 is rotated in a clockwise direction (with reference to FIGS. 3A, 3B and 3C), the pins ride in the slots in a manner to cause locking bolts 76 to extend outwardly and engage with a housing wall to lock money box assembly 10 in place. Rotation of cam 64 in the opposite direction causes the locking bolts 76 to retract thereby permitting the money box assembly to be removed from the housing.

Locking bolts 76 have additional pins 80 projecting outwardly from the opposite side thereof, and positioned in alignment with pins 78. Each locking bolt 76 also has an open-ended corner slot 82 for receiving a spacer 84 through which passes the threaded portion of one of the bolts 28. There are four such spacers 84, one for each of the bolts 28. When the mechanism is assembled, as shown in FIG. 3B, the spacers 84 that are received within the slots 82 also serve to guide locking bolts 76 in their movement between their extended and retracted positions.

A back plate 86 is provided having elongated slots 88 which receive pins 80 of locking bolts 76 which also serve to guide the locking bolts in their movement between their extended and retracted positions. As shown in FIG. 3A, slots 88 are positioned on opposite sides of a central opening 90 which receives shaft 62 and nut 72. A plurality of additional openings 92 are formed in back plate 86 through which pass the threaded portions of bolts 28. FIG. 3A shows nuts 30 fastened on to bolts 28 with money box 14 removed for purposes of clarity. A pair of holding spring clips 94 are mounted on back plate 86 and are positioned with their free ends projecting through respective openings 96. Clips 94 exert a force on locking bolts 76 urging them against cam 64 when the unit is assembled.

Back plate 86 also has top and bottom flanges 98 which extend rearwardly in the direction of money box 14. The arrangement is such that bottom flange 98 fits under the bottom wall 20 of money box 14 when the unit is assembled.

In accordance with the invention, cam 64 is formed of plastic or other fusible material having a melting temperature substantially lower than the melting temperature of the tumbler lock 42. The use of a fusible cam 64 will frustrate attempts by persons to defeat the lock mechanism by a method wherein the tumbler lock mechanism 12 is destroyed by melting. In this regard, heat necessary to melt the tumbler lock mechanism will be transmitted to the fusible cam both through the rotating shaft 62 of lock 42 and through the body of the lock mechanism in general. Fusible cam 64 need only be made out of material with a melting point lower than the melting point of the tumbler lock 42. This will ensure that cam 64 is destroyed by the heat which is applied to the lock. Once the cam is destroyed, attempts to open the lock by inserting a screwdriver or other device into the lock mechanism 12 after tumbler lock 42 has been destroyed will only result in rotation of shaft 62 without having any effect on locking bolts 76 because the transmission link therebetween has been destroyed. Locking bolts 76 thus remain in their extended position to prevent unauthorized withdrawal of money box assembly 10 from the housing to which it is connected.

Although the cam 64 may be made of low melting metal alloys and the like, it has been found that synthetic plastic materials are most suited from the point of strength and melting point characteristics. In addition, many of the synthetic plastic materials are self-lubricating thereby reducing or eliminating any problem with respect to binding of the cam resulting from its contact with the various other elements in the lock mechanism. Although many of the thermo-plastic materials are generally suitable for forming the fusible cam, Delrin has been found particularly suitable. Delrin is a moldable linear polyoxymethylene-type acetal resin, made by the polymerization of formaldehyde, and has a relatively high strength and solvent resistance. (Delrin is a registered trade name belonging to E. I. Dupont de Nemours and Company). It has a melting point of about 180° C., which has been found suitable for the present invention use. In actual tests, it has been found that attempts to torch a lock employing a cam made of Delrin caused the cam to disintegrate.

The fusible cam can also be made of materials which, while not disintegrating, substantially lose their strength and become inoperative to function as the driving member for the locking bolts.

While a preferred embodiment of the invention has been shown and described in detail, it will be readily understood and appreciated that numerous omissions, changes and additions may be made without departing from the spirit and scope of the present invention.

What is claimed is:

1. In a coin operated mechanism having a housing, the money box assembly improvement comprising:

a key coded lock;

at least one locking bolt movable between a locked position wherein said bolt engages with the wall of said housing to which the money box assembly is mounted, and an unlocked position to permit said assembly to be removed from said housing thereby to gain access to the money box;

a fusible transmission member operatively connected as a transmission link between said lock and said locking bolt;

said transmission member being formed of a material having a predetermined melting temperature substantially lower than the melting temperature of the material forming said lock;

said predetermined temperature being lower than the temperature transmitted through said lock to said transmission member when sufficient heat is applied to destroy the lock;

said predetermined temperature melting said transmission member to remove it as a link between said lock and said locking bolt rendering said transmission member inoperative for moving said locking bolt from said locked position to said unlocked position.

2. The improvement of claim 1 wherein;

said transmission member has a cam surface, and said locking bolt includes at least one cam follower member engaging said cam surface;

movement of said cam surface between first and second positions driving said locking bolt between said locked and unlocked positions;

fusing of said transmission member destroying the operative connection between said lock and said locking bolt.

3. The improvement of claim 2, wherein said cam surface defines a slot in said transmission member and said cam follower is a pin extending into said slot.

4. The improvement of claim 1, wherein said fusible transmission member is plastic.

* * * * *